United States Patent [19]

Suzuki et al.

[11] Patent Number: 4,756,293

[45] Date of Patent: Jul. 12, 1988

[54] FUEL INJECTION APPARATUS

[75] Inventors: Yuji Suzuki; Yoshio Kuroda; Kiyotaka Ogata, all of Higashi-Matsuyama, Japan

[73] Assignee: Diesel Kiki Co., Ltd., Tokyo, Japan

[21] Appl. No.: 17,346

[22] Filed: Feb. 20, 1987

[30] Foreign Application Priority Data

Feb. 21, 1986 [JP] Japan ..... 61-35364

[51] Int. Cl.[4] ..... F02B 3/00

[52] U.S. Cl. ..... 123/531; 123/533

[58] Field of Search ..... 123/531, 533, 585, 586

[56] References Cited

U.S. PATENT DOCUMENTS 4,387,695 6/1983 Höppel et al. ..... 123/531

4,387,696 6/1983 Yogo et al. ..... 123/531

4,465,050 8/1984 Igashira et al. ..... 123/531

4,561,405 12/1985 Simons ..... 123/531

FOREIGN PATENT DOCUMENTS 58-160520 9/1983 Japan ..... 123/531

*Primary Examiner*—Raymond A. Nelli

*Attorney, Agent, or Firm*—Wenderoth, Lind & Ponack

[57] ABSTRACT

A fuel injection apparatus for injecting fuel adjusted in quantity in response to at least one of engine load and engine speed by utilization of the pressure of compressed air has the characteristic that the supplying time of the compressed air is set longer at at least one of low engine load and low engine speed that at at least one of high engine load and high engine speed.

1 Claim, 4 Drawing Sheets

FUEL INJECTION APPARATUS

FIELD OF THE INVENTION AND RELATED ART STATEMENT

The present invention relates to a fuel injection apparatus adapted to inject fuel adjusted in quantity in accordance with a state of engine load or rotation by utilization of the pressure of compressed air, and control the supplying cycle and time of the compressed air in accordance with a state of engine load or rotation.

There has heretofore been adopted, as a measure for improving the exhaust gas of an automobile or means for improving fuel charge and performance of an engine, a fuel injection system capable of supplying fuel to an engine adjusted in quantity in accordance with engine load by utilization of the pressure of compressed air to produce a mixed gas. With the prior art system, it is necessary to precisely control the supply of the compressed air in accordance with a state of engine load in order to ensure an optimum combustion condition irrespective of any state of engine load.

A technique capable of fulfilling this requirement is disclosed in Japanese Patent Public Disclosure No. 58-160520 which is directed to a fuel injection apparatus providing an engine with a pulse generator for generating pulses in proportion to the rotation speed of the engine, and supplying the pulses from the pulse generator to a solenoid operation type air valve, thereby increasing the number of the pulses to be supplied to the air valve. Such a case is where an increase in quantity of fuel is required under acceleration, for example, to increase the number of opening/closing operations of the air valve and increase the quantity of the fuel supplied to the engine. With the conventional apparatus, although it is possible to regulate the number of opening/closing operations of the air valve in accordance with the engine load, given that the valve opening time is set constant per cycle and the quantity of the compressed air supplied per cycle is set equivalent, there is a possiblity of the quantity of the compressed air supplied fluctuating (from a minute point of view) through failure to respond to the quantity of fuel changing momentarily in accordance with the engine load states. Thus, it is difficult to ensure an optimum combustion condition irrespective of any state of engine load.

OBJECT AND SUMMARY OF THE INVENTION

One object of the present invention is to provide a fuel injection apparatus capable of controlling the supplying time of compressed air for supply fuel under pressure and adjusted in quantity in accordance with a state of engine load or rotation so as to comply with a state of engine load, thereby ensuring optimum combustion irrespective of any state of engine load.

Another object of the present invention is to provide a fuel injection apparatus capable of regulating the supplying time of the aforementioned compressed air at a low-load or low-speed engine drive to prevent an after-dripping phenomenon resulting from the fuel droplets still remaining in a fuel flow passage, and smoothly drive an engine at the aforementioned engine drive at which influence of the after-dripping phenomenon is marked.

To attain the objects described above, according to the present invention, there is provided a fuel injection apparatus for injecting fuel adjusted in quantity responsive a state of engine load or rotation by utilization of the pressure of compressed air, and characterized in that the supplying time of the compressed air is regulated in accordance with the state of engine load or rotation and that the supplying time of the compressed air is set longer at a low-load or low-speed engine drive than at a high-load or high-speed engine drive.

The above and other objects, characteristic features and advantages of the present invention will become more apparent to those skilled in the art as the disclosure is made in the following description of a preferred embodiment of the invention, as illustrated in the accompanying drawings.

DETAILED DESCRIPTION OF THE PREFERRED EMBODIMENT

The present invention applied to a fuel injection system for supplying fuel adjusted in quantity to a combustion chamber by utilization of the pressure of compressed air will now be described with reference to the illustrated embodiment.

Figure 1:
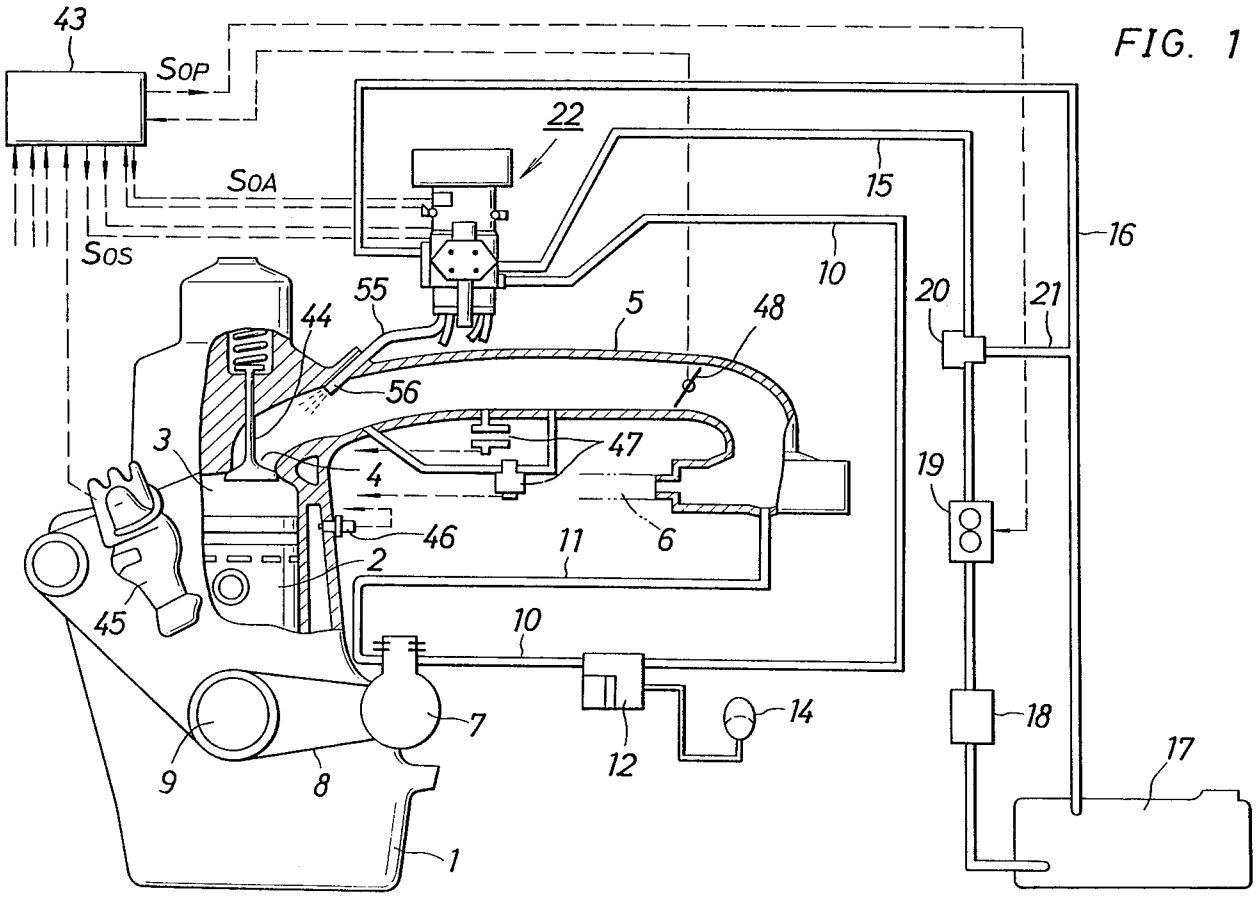
FIG. 1 is a schematic explanatory view illustrating an injection system using one embodiment of the fuel injection apparatus according to the present invention.

In FIG. 1, reference numeral 1 designates an engine body and numeral 2 a piston accommodated within a combustion chamber 3 to which a suction air passage 4 of a suction manifold 5 opens. To the end of the suction manifold 5 there is connected an air delivery pipe 6 communicating with an air cleaner (not shown). Denoted by numeral 7 is an air compressor disposed in the vicinity of the engine body 1, driven by a crank pulley 9 through a belt 8, and provided with a discharge port and a section port connected to one end of an air feed pipe 10 and one end of an air delivery pipe 11 respectively. The other end of the air feed pipe 10 is connected to a fuel injection adjuster 22 which will be described in detail later. Midway in the duct line of the air feed pipe 10 there is disposed an air regulator 12. The other end of the air delivery pipe 11 is connected to the suction manifold 5, thereby making it possible to introduce part of the suction air into the air compressor 7. Numeral 14 designates an accumalator connected to the air regulator 12. Fuel oil feed pipe 15 and fuel oil return pipe 16 have their respective one ends connected to a fuel oil tank 17 and their respective other ends connected respectively to an inflow port 25 and an outflow port 26 of the fuel injection adjuster 22. Around the fuel pipe 15 there are inserted a filter 18, a fuel pump 19 and an oil regulator 20 which is connected to the fuel return pipe via a bypass pipe 21.

Figure 2:
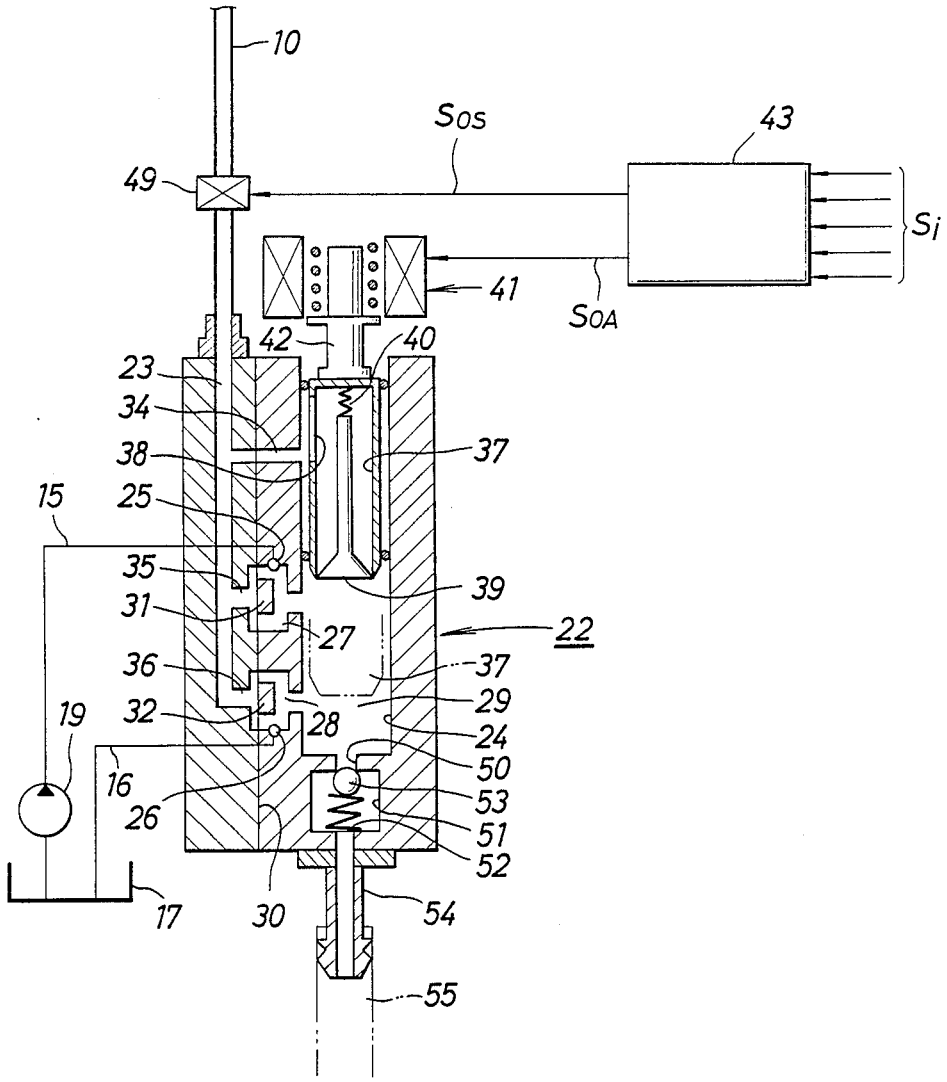
FIG. 2 is an enlarged cross section illustrating a fuel injection adjuster used in the injection system of FIG. 1.

As illustrated in FIG. 2, the fuel injection adjuster 22 is provided therein with an air passage 23 communicating with the air feed pipe 10 and with a cylinder 24. Between the air passage 23 and the cylinder 24, there are provided fuel oil reservoirs 27 and 28 communicating respectively with the inflow and outflow ports 25 and 26 which communicate with a metering chamber 29 formed on the side of the closed end of the cylinder 24. Within the reservoirs 27 and 28 a diaphragm 30 is extended and is provided with an inflow port valve 31 and an outflow port valve 32 for opening and closing the open portions of the reservoirs 27 and 28 communicating with the metering chamber 30. The fuel injection adjuster 22 is also provided therein with first to third air guide bores 34, 35 and 36 communicating with the air passage 23. The first air guide bore 34 also communicates with the cylinder 24. The second and third air guide bores 35 and 36 are open to the rear surface of the diaphragm 30 for permitting pressure to be applied to the diaphragm 30. Within the cylinder 24 is slidably accommodated a tubular metering rod 37 having a longitudinal port 38 formed in the periphery thereof so as to communicate with the first air guide bore 34 and also having a substantially mushroom metering valve 39 accommodated therewithin so as to hang down by means of a spring 40 which biases the metering valve 39 to stop up the open end of the metering rod 37 under normal conditions. The closed end of the metering rod 37 is connected to an operation rod 42 of an actuator 41 which is associated with a control unit 43 so that the operation of the actuator 41 is controlled.

Returning to FIG. 1, the control unit 43 is adapted to input various detection signals from sensors etc. mounted on the engine body 1 etc. such as a crank angle sensor (not shown) for detecting the engine rpm, an ignition switch (not shown) for detecting the ignition timing through a distributor 45, a water temperature sensor 46 for detecting the temperature of cooling water, an air flow meter 47 for detecting the quantity and temperature of the suction air, a throttle valve switch (not shown) for detecting the opening of a throttle valve 48, an accelerator position sensor (not shown) for detecting the position of an accelerator pedal (not shown), for example, and discriminate and calculate these detection signals with a built-in microcomputer, and output control signals.

To be specific, as illustrated in FIGS. 1 and 2, the aforementioned control signals are inputted to the actuator 41, a solenoid valve 49 inserted about the air feed pipe 10, the fuel pump 19 and the fuel regulator 20. Of these control signals, the control signal $S_{OA}$ inputted to the actuator 41 is adapted to control the operation of the actuator 41 in compliance with the engine load and rpm to vertically move the operation rod 42, thereby shifting the metering rod and determining the quantity of fuel supplied to the engine. At the time of low engine load, for example, the control signal $S_{OA}$ causes the metering rod 37 to be moved downwardly within the cylinder 24 as shown by the phantom line in FIG. 2 to decrease the volume of the metering chamber 29, thus setting the fuel adjusted in quantity within the metering chamber 29 to be in small quantities. On the other hand, at the time of high engine load, the control signal $S_{OA}$ causes the metering rod 37 to be moved toward the actuator 41 to increase the volume of the metering chamber 29, thus setting the fuel adjusted in quantity within the metering chamber 29 to be larger in quantity than at the lower engine load.

Figure 3:
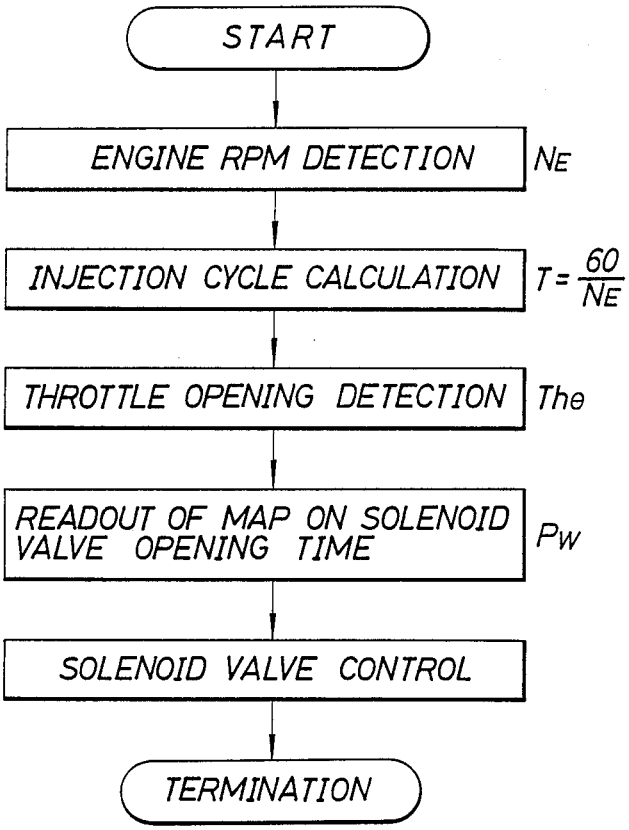
FIG. 3 is a flow chart illustrating one example of solenoid valve control system used in the injection system of FIG. 1.
Figure 4:
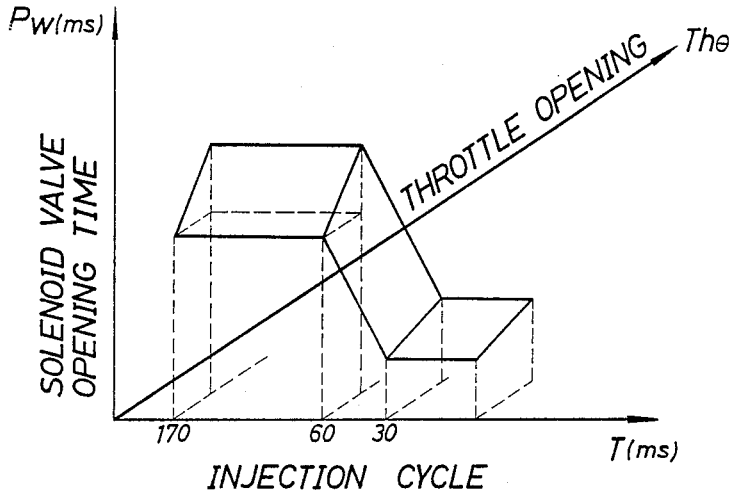
FIG. 4 is a three-dimensional graph showing the interrelationships among an injection cycle, throttle opening, and solenoid valve opening time stored in a control unit used in the injection system of FIG. 1.

The control signal $S_{OS}$ inputted to the solenoid valve 49 is outputted from the control unit 43 at a prescribed timing in the suction stroke of the engine, such as immediately after a suction valve 44 shown in FIG. 1 has been opened and in a descending stroke of the piston 2, for example, and is adapted to open the solenoid valve 49 for a given period of time, thereby making it possible to supply the compressed air into the fuel injection adjuster 22 through the air feed pipe 10. In this case, a solenoid valve opening time Pw per opening of the solenoid valve 49 is calculated in the control unit 43 on the basis of a detection signal of an engine rpm $N_E$ from the crank angle sensor and a detection signal of throttle opening Th⊖ from the throttle valve switch. That is to say, the solenoid valve opening time Pw suitable for the engine load or rpm is determined by the procedures shown in FIG. 3. More specifically, the control unit 43 is adapted to calculate an injection cycle T of a fuel injection valve 56 which will be described in detail later (in other words, a valve opening cycle of the solenoid valve 49) on the basis of the signal of engine rpm $N_E$ so as to comply with the engine rpm, i.e., in accordance with a calculation formula $T=60/N_E$, and to search for the solenoid valve opening time Pw on the basis of the calculated injection cycle T and the signal of throttle opening Th⊖. The microcomputer built in the control unit 43 has stored in advance a prescribed map or graph of FIG. 4 showing the interrelation among the injection cycle T, throttle opening Th⊖ and solenoid valve opening time Pw, and is adapted to read out the solenoid valve opening time Pw from the stored data on the basis of the injection cycle T and throttle opening Th⊖ and to output the read-out signal, the aforementioned control signal $S_{OS}$, into the solenoid valve 49.

The control signal $S_{OP}$ inputted to the fuel pump 19 and fuel regulator 20 is adapted to drive the fuel pump 19 in accordance with the engine load or rpm and to control the quantity and pressure of the fuel fed from the fuel pump 19.

On the other hand, the closed end of the cylinder 24 is provided with fuel oil chamber 51 communicating with the metering chamber 29 through port 50 which is stopped up under normal conditions by a check valve 53 accommodated within the chamber 51 and biased by a valve spring 52. Denoted by numeral 54 is a nipple connected to the end of the fuel injection adjuster 22 so as to communicate with chamber 51. An injection pipe 55 is connected at one end thereof to the nipple 54 as shown in FIG. 2 and at the other end thereof to the open-type fuel injection valve 56 as shown in FIG. 1. The fuel injection valve 56 has an injection aperture portion projected into the suction manifold 5 and directed to the combustion chamber 3.

In the injection system equipped with the fuel injection apparatus of the aforementioned construction, when an engine starts, the fuel pump 19 and the regulator 20 adjust the quantity and pressure of the fuel fed on the basis of the control signal $S_{OP}$ issued from the control unit 43, and transmit the adjusted fuel under pressure into the fuel injection adjuster 22 via feed pipe 15. The fuel introduced into the fuel injection adjuster 22 flows from the inflow port 25 through reservoir 27 into the metering chamber 29. The metering chamber 29 is filled with the fuel in a quantity corresponding to the volume of the metering chamber 29 determined by the shift of the metering rod 37. The excess quantity of fuel flows from reservoir 28 through the outflow port 26 into return pipe 16 and is then returned to the fuel tank 17. Thus, the fuel circulates between the fuel injection adjuster 22 and the fuel tank 17.

With the starting of the engine, the air compressor 7 is driven to compress air sucked therein through the air conduit 11 and discharge the compressed air into the air feed pipe 10. The compressed air is adjusted in pressure by the air regulator 12 and can then be transmitted under pressure into the fuel injection adjuster 22. In this state, when the engine drive is brought to a suction stroke, the suction valve 44 is opened to cause the air in the suction manifold 5 to be sucked into the combustion chamber 3 and, at the same time, the crank angle and the engine rpm $N_E$ at the given crank angle are detected by the crank angle sensor, and the detected signals are inputted to the control unit 43 which also receives a signal of the throttle opening Th⊖ detected by the thottle valve switch. The control unit 43 effects discrimination and calculation on the basis of the inputted signals and detected engine rpm $N_E$, and outputs the control signals $S_{OA}$ and $S_{OS}$ respectively to the actuator 41 and solenoid valve 49.

Figure 5:
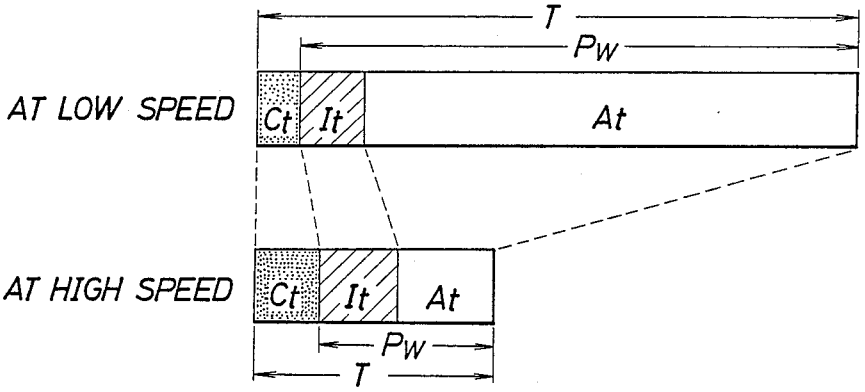
FIG. 5 is a cycle time chart illustrating one example of cycle times of the fuel injection adjuster used in the injection system of FIG. 1 at a low-speed engine drive and at a high-speed engine drive respectively.

When the control signal $S_{OS}$ has been inputted to the actuator 41, the actuator 41 controls the vertical movement of the operation rod 42 in compliance with the level of the inputted signal $S_{OS}$. For example, the operation rod 42 is shifted upwardly at the time of high-load high-speed engine drive to move the metering rod 37 in the same direction, thereby increasing the volume of the metering chamber 29 within the cylinder 24, while it is shifted downwardly at the time of low-load low-speed engine drive to move the metering rod 37 in the same direction to a position shown by the phantom line in FIG. 2, thereby decreasing the volume of the metering chamber 29 within the cylinder 24. Therefore, the quantity adjusting time Ct required to fill the metering chamber 29 with fuel is longer at a high-speed engine drive than at a low-speed engine drive by a length corresponding to the increase in volume of the metering chamber 29, as illustrated in FIG. 5. The fuel within the cylinder 24 urged by the downward movement of the metering rod 37 is returned to the fuel tank 17 from the reservoir 28 through the outflow port 26 and return pipe 16.

The control signal $S_{OS}$ inputted to the solenoid valve 49 is adapted to determine the valve opening movement and valve opening time Pw of the solenoid valve 49. The valve opening time Pw is obtained by the control unit 43 taking the following procedures. That is to say, the control unit 43 calculates the injection cycle T of the fuel injection valve 56 from the signal of the inputted engine rpm $N_E$ in accordance with the calculation formula $T=60/N_E$ stored in advance as illustrated by the solenoid valve control system in FIG. 3 and, utilizing the calculated injection cycle T and the inputted signal of throttle opening Th⊖, reads out the valve opening time Pw of the solenoid valve 49 from the map or graph stored in advance and shown in FIG. 4. As shown in FIG. 4, the valve opening time Pw is liable to increase stepwise in proportion as the injection cycle T becomes large (in other words, in proportion as the engine rpm $N_E$ becomes small) and is also liable to increase in proportion as the throttle opening Th⊖ becomes large (in other words, in proportion as the engine drive is brought to a high-load high-speed drive).

When the control signal $S_{OS}$ for determining the fuel quantity adjusting start and the valve opening time Pw has been inputted to the solenoid valve 49 from the control unit 43, the solenoid valve 49 is opened to permit the compressed air in the air feed pipe 10 to be directed into the air passage 23 formed in the fuel injection adjuster 22. The compressed air introduced into the air passage 23 is directed into the first to third air guide bores 34, 35 and 36 all communicating with the air passage 23. The compressed air directed into the second and third air guide bores 35 and 36 acts on the diaphragm 30 to be shifted rightwards as in FIG. 2, thereby stopping up the openings of the reservoirs 27 and 28 with the inflow and outflow port valves 31 and 32, respectively. As a result, the communication between the metering chamber 29 and the reservoirs 27 and 28 is cut off to hermetically seal the metering chamber 29. The compressed air directed into the first air guide bore 34 is further directed into the metering rod 37 through the longitudinal port 38 to act on the metering valve 39 accommodated within the metering rod 37. When the internal pressure of the metering rod 37 reaches a prescribed level, the metering valve 39 is projected downwardly as in FIG. 2 against the biasing force of the spring 40 to open the metering valve 39 relative to the open end of the metering rod 37.

When the metering valve 39 has been opened, as described above, the compressed air within the metering rod 37 acts on the fuel adjusted in quantity within the metering chamber 29 and then on the check valve 53. As a reusult, the check valve 53 is opened against the biaising force of the valve spring 52 to cause the fuel mixed with the compressed air within the metering chamber 29 to be injected into the injection pipe 55 through the nipple 54, moved at a high speed within the injection pipe 55 and injected into the suction manifold 5 through the fuel injection valve 56.

The injection time It beginning from the valve opening timing of the solenoid valve 49, passing through the valve opening of the check valve 53 and movement of the mixed gas of fuel and compressed air from the metering chamber 29 to the fuel injection valve 56 and terminating in the injection of the whole quantity of the mixed gas from the injection valve 56 is determined as the result of the valve opening of the solenoid valve 49 and terminated within the solenoid valve opening time Pw. Therefore, the injection time It is regarded as part of the solenoid valve opening time Pw. When the compressed air supplied from the solenoid valve 49 has constant pressure, the injection time It varies depending on the speed at which the mixed gas is moved within the fuel flow passages and, therefore, is slightly longer at a high-speed engine drive than at a low-speed engine drive owing to the difference in quantity of the fuel between the engine drives.

After the substantial injection of the mixed gas has been completed, however, the solenoid valve 49 is still kept open to supply excess compressed air substantially not participating in the injection of the mixed gas into the fuel flow passages. The excess compressed air blows away the fuel droplets remaining within and attached to the fuel flow passages during its passing through the fuel flow passages and discharges the fuel droplets out of the fuel injection valve 56, thereby preventing the after-dripping phenomenon resulting from the residual fuel droplets. The introduction of such a large quantity of compressed air facilitates the mixed gas being in a spray or gasified form and produces stable swirl within the combustion chamber 3. The termination of the supplying time At of the excess compressed air is determined by the valve opening time Pw of the solenoid valve 49, and the supplying time At corresponds to the substantial difference obtained by subtracting the injection time It from the valve opening time Pw and is determined by the injection cycle T and valve opening time Pw based on the engine load or rotation. Therefore, the excess compressed air contributes greatly to a low-load low-speed engine drive at which the influence of the after-dripping phenomenon upon the combustion state is conspicuous.

The mixed gas thus injected into the suction manifold 5 is sucked into the combustion chamber 3 kept under negative pressure and is mixed with the ordinary air supplied from the suction manifold 5 into the combustion chamber 3 to form a mixed gas.

Upon lapse of the valve opening time Pw of the solenoid valve 49 determined by the control signal $S_{OS}$ after the mixed gas has been injected into the suction manifold 5, the solenoid valve 49 is closed to stop supplying the compressed air from the air feed pipe 10 into the fuel injection adjuster 22. For this reason, the internal pressure of the first to third air guide bores 34, 35 and 36 within the fuel injection adjuster 22 is restored to the initial level and the internal pressure of the metering rod 37 communicating the first air guide bore 34 is also restored to the initial level, thereby restoring the metering valve 39 to its original position by means of the spring 40 to thereby stop up the open end of the metering rod 37 with the metering valve 39. The metering valve 39 is thus closed and, at the same time, the internal pressure of the metering chamber 29 is restored to the initial level, thereby restoring the check valve 53 to its original position by means of the valve spring 52 to thereby stop up the oil port 50 with the check valve 53. The metering chamber is thus sealed hermetically. As soon as the internal pressure of the second and third air guide bores 35 and 36 have been restored to the intitial level, as described above, the diaphragm 30 is restored to its original position due to its own elasticity. At this time, as the inflow and outflow port valves 31 and 32 are moved together with the diaphragm 30, the reservoirs 27 and 28 communicate with the metering chamber 29. Therefore, the fuel in the reservoirs 27 and 28 flows into the metering chamber 29. The quantity of the fuel within the metering chamber 29 determined by the shift of the metering rod 37 is again adjusted.

As described in the foregoing, the fuel injection apparatus according to the present invention is adapted to inject fuel adjusted in quantity responsive to at least one of engine load and engine rotation by utilization of the pressure of compressed air and is characterized in that the supplying time of the compressed air is responsive to at least one of engine load and engine rotation and that the supplying time of the compressed air is set longer at least one of a low-load and low-speed engine drive than at least one of a high-load and high-speed engine drive. Therefore, the optimum combustion state can be realized irrespective of any state of engine load or rotation. Also, because it is possible to facilitate the fuel being sprayed or atomized by supplying the compressed air thus preventing the after-dripping phenomenon resulting from residual fuel droplets within the fuel flow passages by means of the compressed air, the engine can be smoothly driven even at a low-load or low-speed drive at which the influence of the after-dripping phenomenon upon the combustion state is marked.

What is claimed is:

1. A fuel injection apparatus for injecting fuel responsive to a rotary speed of an engine by utilizing the pressure of compressed air, said apparatus comprising means for regulating the supplying time of the compressed air responsive to at least one of the rotary speed of the engine and the load of the engine, and said regulating means including means for supplying the compressed air for a longer time at at least one of low rotary speed and low load of the engine than at at least one of high rotary speed and high load of the engine.

* * * * *